US007874951B2

(12) United States Patent
Leiss

(10) Patent No.: US 7,874,951 B2
(45) Date of Patent: Jan. 25, 2011

(54) MOTOR TO ACCESSORY DRIVE SYSTEM

(75) Inventor: Daniel Leiss, Somerset, PA (US)

(73) Assignee: Jenny Products, Incorporated, Somerset, PA (US)

( * ) Notice: Subject to any disclaimer, the term of this patent is extended or adjusted under 35 U.S.C. 154(b) by 460 days.

(21) Appl. No.: 12/075,908

(22) Filed: Mar. 14, 2008

(65) Prior Publication Data

US 2009/0233743 A1 Sep. 17, 2009

(51) Int. Cl.
*F16D 1/00* (2006.01)
*F16H 57/02* (2006.01)

(52) U.S. Cl. ..... 474/146; 474/144; 474/149; 474/150

(58) Field of Classification Search ..... 474/86, 474/87, 101, 110, 144, 146, 149, 150, 237
See application file for complete search history.

(56) References Cited

U.S. PATENT DOCUMENTS 2,613,544 A * 10/1952 Cullman ..... 474/88
3,631,734 A * 1/1972 Wagner ..... 474/117
3,924,483 A * 12/1975 Walker et al. ..... 474/86
4,103,846 A * 8/1978 Loofbourow et al. .... 242/356.4
4,277,240 A * 7/1981 Kraft ..... 474/110
4,466,803 A * 8/1984 Wilson ..... 474/138
4,908,008 A * 3/1990 Gorski ..... 474/146
5,702,315 A * 12/1997 Sakai et al. ..... 474/94
6,602,155 B2 * 8/2003 Buss et al. ..... 474/135
7,322,895 B2 * 1/2008 Namuduri ..... 474/110
2002/0039944 A1 * 4/2002 Ali et al. ..... 474/135
2007/0142145 A1 * 6/2007 Namuduri ..... 474/110

* cited by examiner

*Primary Examiner*—Emmanuel M Marcelo
(74) *Attorney, Agent, or Firm*—Carothers & Carothers

(57) ABSTRACT

A motor to accessory drive system wherein an electric or gasoline motor, having a housing with a drive shaft end protruding from the motor housing, is mounted with respect to the accessory to be driven, such as a pump or a generator, which also has a housing with a drive shaft protruding from the accessory housing, with a mounting plate secured at one end to the motor housing, and secured at another end to the accessory housing whereby the accessory is supported from the motor. The mounting plate is provided with spaced apertures with the drive shaft ends of the motor and accessory respectively protruding through the apertures in parallel alignment. A drive pulley is mounted on each of the protruding drive shaft ends in alignment in a common plane and an endless belt is in driving engagement with the pulleys. The accessory can accordingly be mounted at many possible different attitudes relative to the motor and the belt drive system can be easily covered with a protective guard which is readily attached to the mounting plate.

9 Claims, 3 Drawing Sheets

MOTOR TO ACCESSORY DRIVE SYSTEM

BACKGROUND OF THE INVENTION

The present invention pertains to a motor and a motor driven accessory, such as a pump, combination wherein an accessory is driven by a motor, such as an electric motor or a gasoline engine.

Pumps, such as water pumps and generators, are normally driven by a motor, such as an electric motor or a gasoline engine, and the pump and motor are generally combined as a single unit for portability. Typically, the motor and pump are mounted to a common deck plate or platform and spacers or risers are utilized to properly position the pump and the motor with respect to each other for driving engagement with a belt drive.

Problems encountered with such an arrangement are that the pump cannot be easily positioned relative to the motor. The combination limits the possibilities as to how the pump will be positioned relative to the motor and it is awkward, difficult and expensive to add additional equipment, such as a generator, to the combination for driving engagement with the same motor.

This typical arrangement also makes it difficult for utilizing belt tensioner, and the unit is not compact. Also, because of the fixed arrangement between the pump and the motor relative to the supporting deck plate or platform, drive pulley clearance problems readily occur when initially mounting the motor and pump relative to each other on the deck.

Furthermore, with this prior art arrangement, common felt guard attachments cannot be utilized therefore making the construction expensive, and in addition, the arrangement complicates maintenance surface.

SUMMARY OF THE INVENTION

The motor to accessory drive system of the present invention is provided for a motor, such as an electric motor or a gasoline engine, having a housing with a drive shaft end protruding from the motor housing and an accessory, such as a water or hydraulic fluid pump, having a housing with a drive shaft end protruding from the pump housing. A mounting plate is secured at one end to the motor housing and secured at another end to the accessory housing whereby the accessory is supported from the motor. This mounting plate is providing with space apertures with the drive shaft ends respectively protruding through the apertures in parallel alignment. Drive pulleys are mounted on each of the protruding drive shaft ends with the pulleys aligned in a common plane, and an endless belt is provided in driving engagement with the pulleys. The endless belt is typically in the form of an elastic drive belt, but may also be provided in the form of a drive chain.

A belt guard cover may be readily provided to cover the belt and the pulleys by securing the cover directly to the mounting plate.

The mounting plate may be expanded to any desired shape or size, such as triangular, in order to attach additional accessory equipment thereto, such as a generator, to be additionally driven by the motor.

The arrangement also permits the ability to position the pump relative to the motor at the most desired attitude, and provides a combination which is much more compact and lighter than the assembly of the prior art. In addition, it is much easier to provide for belt tensioning, if desired, and there is less problem in providing clearance for the pulleys. It is easy to provide a guard cover for the pulleys and belt drive as the cover may be readily attached to the plate itself.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention, wherein:

DETAILED DESCRIPTION OF THE PREFERRED EMBODIMENTS

Figure 1:
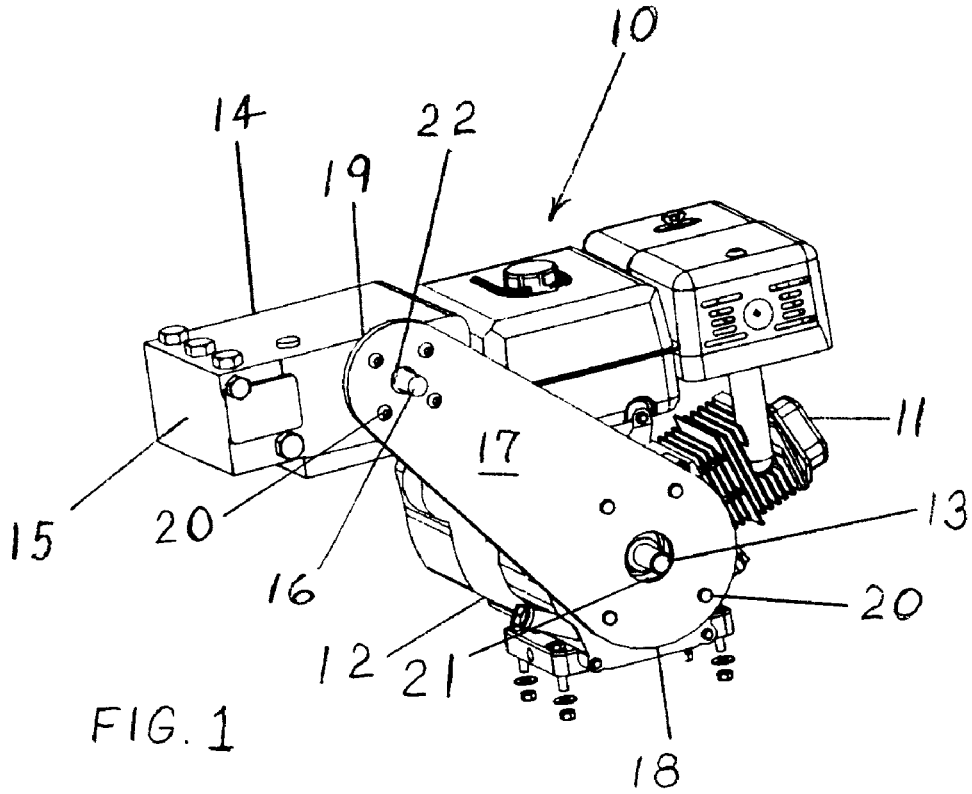
FIG. 1 is a perspective view of the motor to accessory drive system of the present invention illustrated without the drive pulleys and belt drive, as driving a pump from a gasoline engine as the motor.
Figure 2:
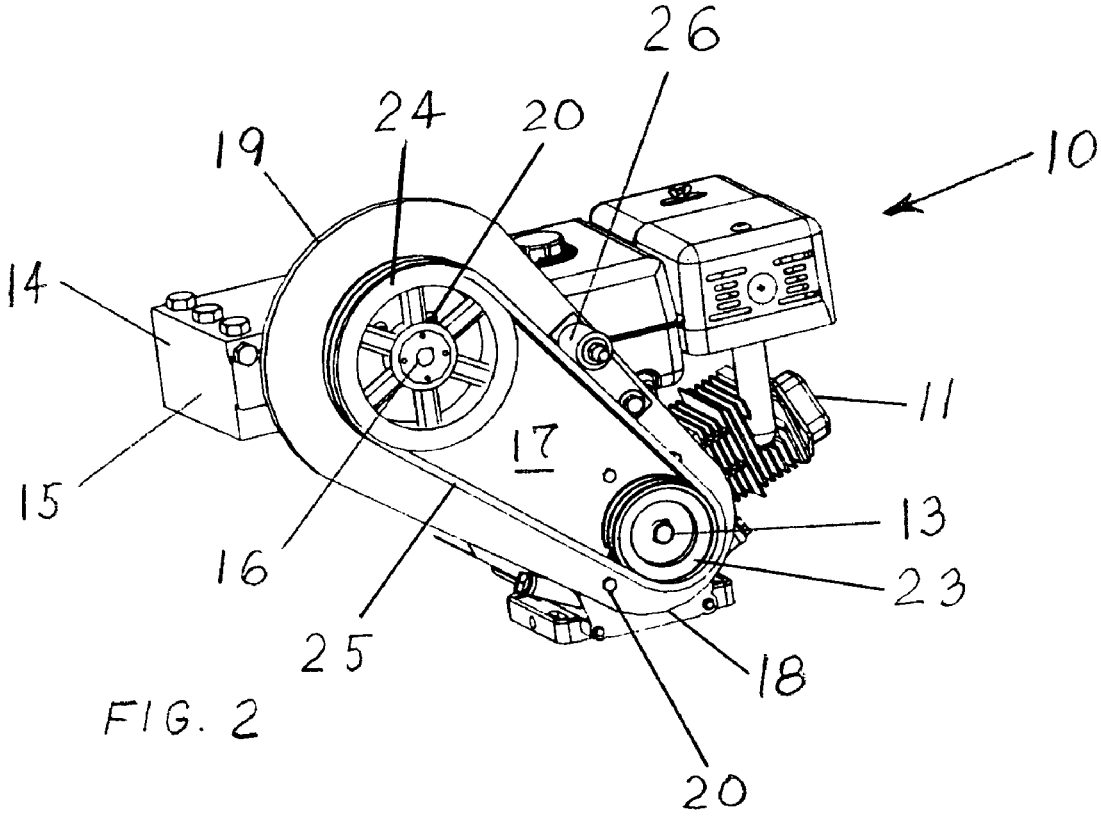
FIG. 2 is a perspective view of the motor to accessory drive system illustrated in FIG. 1 with the drive pulleys and the drive belt shown in place and with the addition of a belt tensioner.
Figure 3:
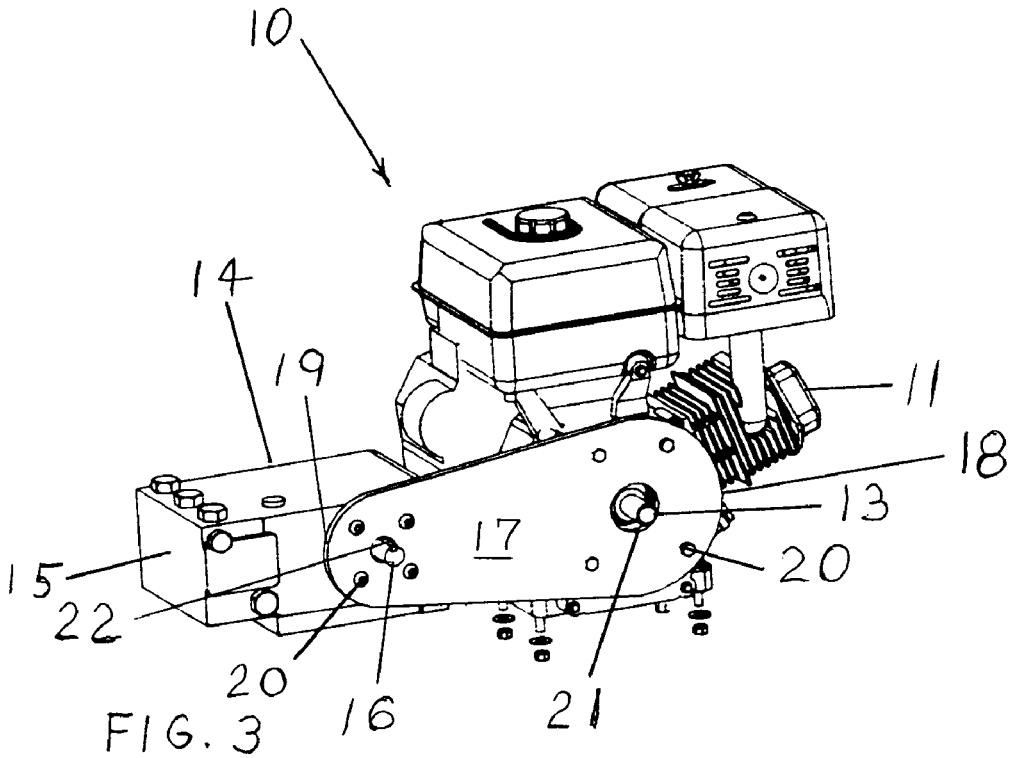
FIG. 3 is a perspective view of the motor to accessory drive system of the present invention illustrated without the drive pulleys and the belt drive as illustrated in FIG. 1, but with the pump positioned at a different attitude from that illustrated in FIG. 1.
Figure 4:
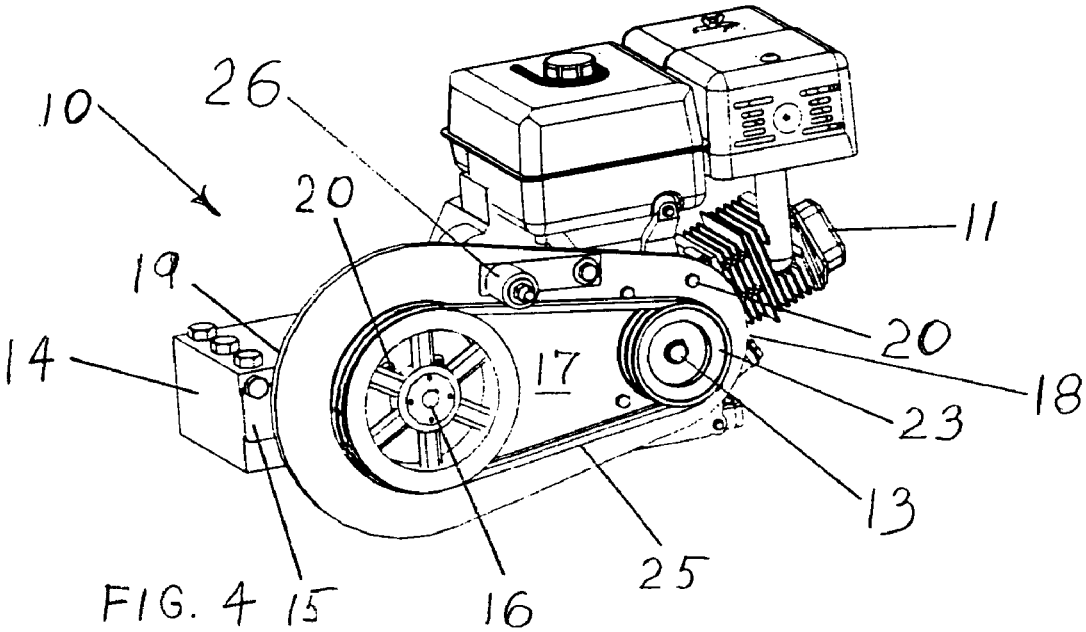
FIG. 4 is a perspective view of the motor to accessory drive system shown in FIG. 3 with the inclusion of drive pulleys, the drive belt and a belt tensioner.
Figure 5:
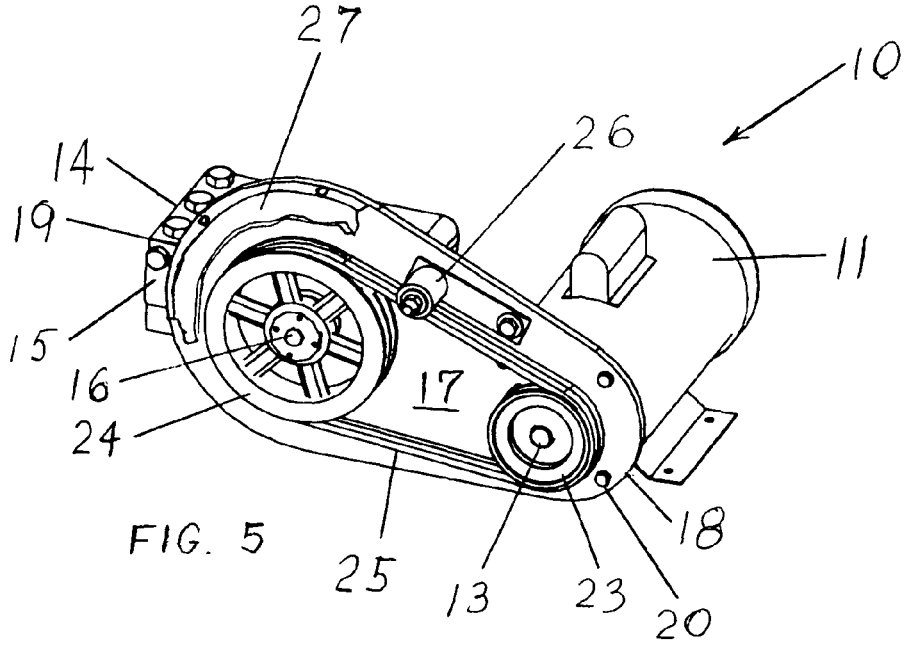
FIG. 5 is a perspective view of the motor to accessory drive system of the present invention as utilized in combination with an electric motor as the drive motor for the pump and with a belt cover partially sectioned away.

Referring to the drawings, the motor to accessory drive system 10 of the present invention is illustrated. A drive motor 11, in the form of a gasoline engine in FIGS. 1 through 4 and FIG. 6, and as an electric motor in FIG. 5, is shown with a housing 12 having a drive shaft end 13 protruding from the motor housing 12. A water pump 14 is the driven accessory and the pump 14 has a housing 15 with a pump drive shaft end 16 protruding from the pump housing 15.

A mounting plate 17 is secured at one end 18 to motor housing 12 and secured at another end 19 to pump housing 14 respectively by bolts 20 whereby the pump 14 is thereby supported from the motor 11.

Mounting plate 17 is provided with spaced apertures 21 and 22 with the drive shaft ends 13 and 16 respectively protruding through apertures 21 and 22 in parallel alignment. Drive pulleys 23 and 24 are mounted respectively on protruding drive shaft ends 13 and 16 whereby pulleys 23 and 24 are aligned in a common plane. Endless flexible drive belt 25 is in driving engagement with the pulleys 23 and 24. In addition, a belt tensioner 26 is provided to tension belt 25 in a conventional manner by mounting the tensioner to the mounting plate 17.

The entire pulley and belt combination is covered with a protective guard cover 27 (FIG. 5) which is directly mounted to mounting plate 17.

Figure 6:
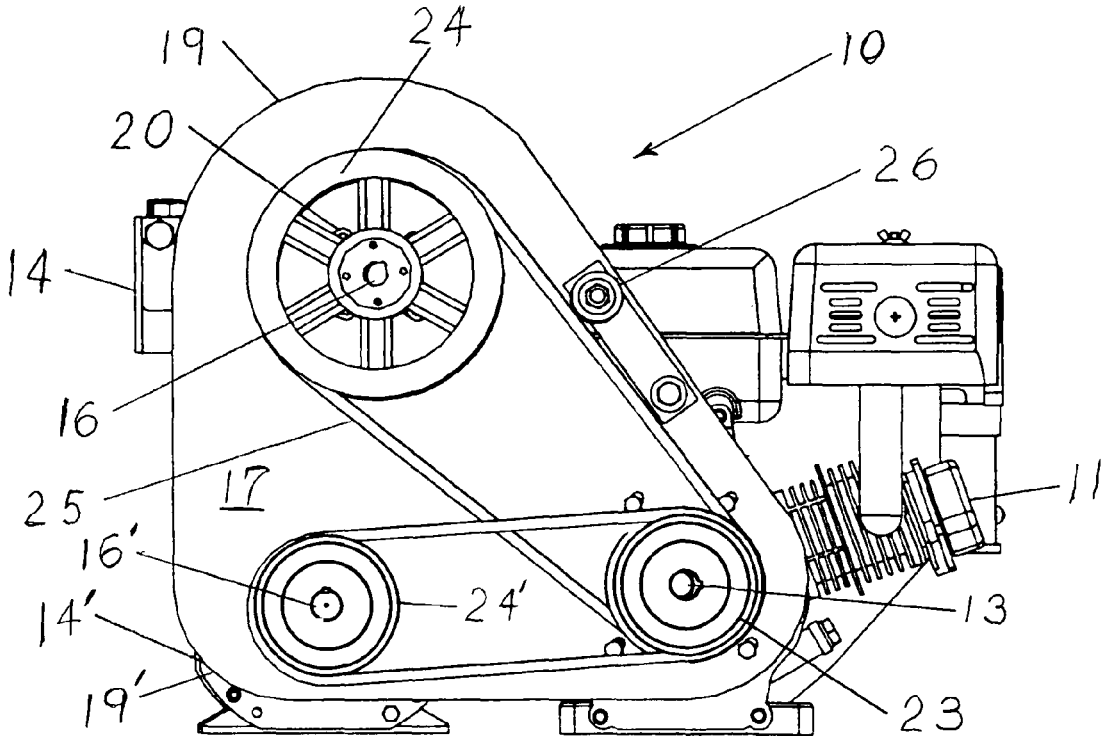
FIG. 6 is a view in front elevation of another embodiment of the motor to accessory drive system of the present invention illustrating a gasoline engine in driving engagement with a pump and an electric generator.

In the embodiments of FIGS. 1 through 5, the mounting plate 17 is shown as being oblong. However, mounting plate 17 may be provided in a triangular configuration as shown in FIG. 6 whereby a second attachment or accessory to be driven, such as a generator 14', may also be mounted to be simultaneously driven from the motor 11 in the same manner as the pump 14.

The entire unit is very compact compared to the prior art structures and permits the pump 14 to be mounted at many possible different positions relative to motor 11 whereby the unit is compact, more portable, easier to manufacture, provides less problems with regard to pulley clearance and is easy to provide a guard cover therefore and guard cover attachment.

I claim:

1. A motor to accessory drive system, comprising:

a motor having a housing with a drive shaft end protruding from said motor housing;

an accessory to be driven by said motor and having a housing with a drive shaft end protruding from said accessory housing;

a mounting plate secured at one end to said motor housing and secured at another end to said accessory housing whereby said accessory is fully supported from said motor exclusively by said mounting plate;

said mounting plate having spaced apertures with said drive shaft ends respectively protruding through said apertures in parallel alignment;

a drive pulley mounted on each of said protruding drive shaft ends, said pulleys being aligned in a common plane; and endless belt means in driving engagement with said pulleys.

2. The drive system of claim 1, wherein said motor is an electric motor.

3. The drive system of claim 1, wherein said motor is a gasoline engine.

4. The drive system of claim 1, wherein said belt means is a flexible drive belt.

5. The drive system of claim 1, including a cover covering said pulleys and belt means, said cover secured to said mounting plate.

6. The drive system of claim 1, wherein said accessory is a pump.

7. The drive system of claim 1, wherein said accessory is a generator.

8. The drive system of claim 1, including a belt tensioner mounted on said mounting plate and engaging said endless belt means.

9. The drive system of claim 1, wherein said mounting plate is substantially triangular, thereby providing three ends with an aperture in each of the three ends with said shaft ends protruding respectively through two of said apertures, and including a second accessory to be driven by said motor and having a housing with a drive shaft end protruding from said second accessory housing, said mounting plate secured at a third end to said second accessory housing with said second accessory drive shaft end protruding through a third aperture on said third end in parallel alignment with said motor drive shaft end, a third drive pulley mounted on said second accessory drive shaft end in alignment in a common plane with said motor drive shaft end drive pulley, and said endless drive belt means in driving engagement with said motor and third drive pulleys.

* * * * *